US005754499A

United States Patent [19]

Lin

[11] Patent Number: 5,754,499

[45] Date of Patent: May 19, 1998

[54] CLOCK SHELL

[76] Inventor: Te-Kuei Lin, No. 128, Sec. 4, Chung-Yang Rd., Tu-Cheng City, Taipei Hsien, Taiwan

[21] Appl. No.: 770,296

[22] Filed: Dec. 20, 1996

[51] Int. Cl.[6] ..... G04B 37/00; G04B 19/06

[52] U.S. Cl. ..... 368/88; 368/236; 368/276

[58] Field of Search ..... 368/76, 80, 88, 368/223, 228, 232, 236, 276, 277, 285, 316–317

[56] References Cited

U.S. PATENT DOCUMENTS 4,506,993 3/1985 Brown ..... 368/314

4,718,773 1/1988 O'Donoghue ..... 368/276

5,142,512 8/1992 Takano et al. ..... 368/232

*Primary Examiner*—Vit W. Miska

*Attorney, Agent, or Firm*—Bacon & Thomas

[57] ABSTRACT

A clock shell including a frame, cut into a series of frame sections glued to a decorative covering layer, the frame sections being abutted against one another end by end and formed into a particular configuration, and a shell mounted within the frame sections of the frame, the shell having a raised endless line raised from the front side and defining an outer decoration area and an inner decoration area that can be made in the form of a dial of a clock, a pattern, a landscape, etc.

9 Claims, 5 Drawing Sheets

CLOCK SHELL

BACKGROUND OF THE INVENTION

The present invention relates to clock shells, and more particularly to such a clock shell which is comprised of a shell and a frame mounted around the shell, wherein the frame is cut into a series of frame sections that are abutted against one another end by end to fit the configuration of the shell.

A regular clock is generally comprised of a shell which holds a movement and a dial, and a frame mounted around the periphery of the shell. The frame is injection-molded or die-cast from plastic in a particular color. When special colors or trimmings are required, the frame must be processed further. Because the frame is injection-molded or die-cast from plastic, a different mold should be used when to make a different shape of frame. This limitation greatly increases the manufacturing cost of clocks. Because the frame is made in integrity, its mounting procedure is complicated. Furthermore, it is not easy to install a dial to the shell of the clock shell.

SUMMARY OF THE INVENTION

According to one aspect of the present invention, the clock shell is comprised of a shell and a frame mounted around the shell, wherein the frame is cut into a series of frame sections glued to a decorative covering layer, so that the frame can he conveniently fastened to the clock shell by attaching the frame sections to the periphery of the shell and abutting them one against another end by end.

According to another aspect of the present invent ion, the two opposite ends of each frame section are cut into a respective bevel cut edge at a predetermined angle so that the frame sections can be abutted against one another end by end to form a particular configuration.

According to still another aspect of the present invention, the decorative covering layer can be a veneer or the like glued to the surface of the frame.

According to still another aspect of the present invention, the frame sections are processed having a smoothly curved or plain surface, which decorates the appearance of the clock.

According to still another aspect of the present invention, the shell has a raised endless line of a particular configuration raised from the front side and defining with the shell two decoration panel areas, that can be a dial, a pattern, or a landscape respectively.

BRIEF DESCRIPTION OF THE DRAWINGS

FIG. 2A is a partial view in an enlarged scale of one frame section according to the present invention;

DETAILED DESCRIPTION OF THE PREFERRED EMBODIMENT

Figure 1:
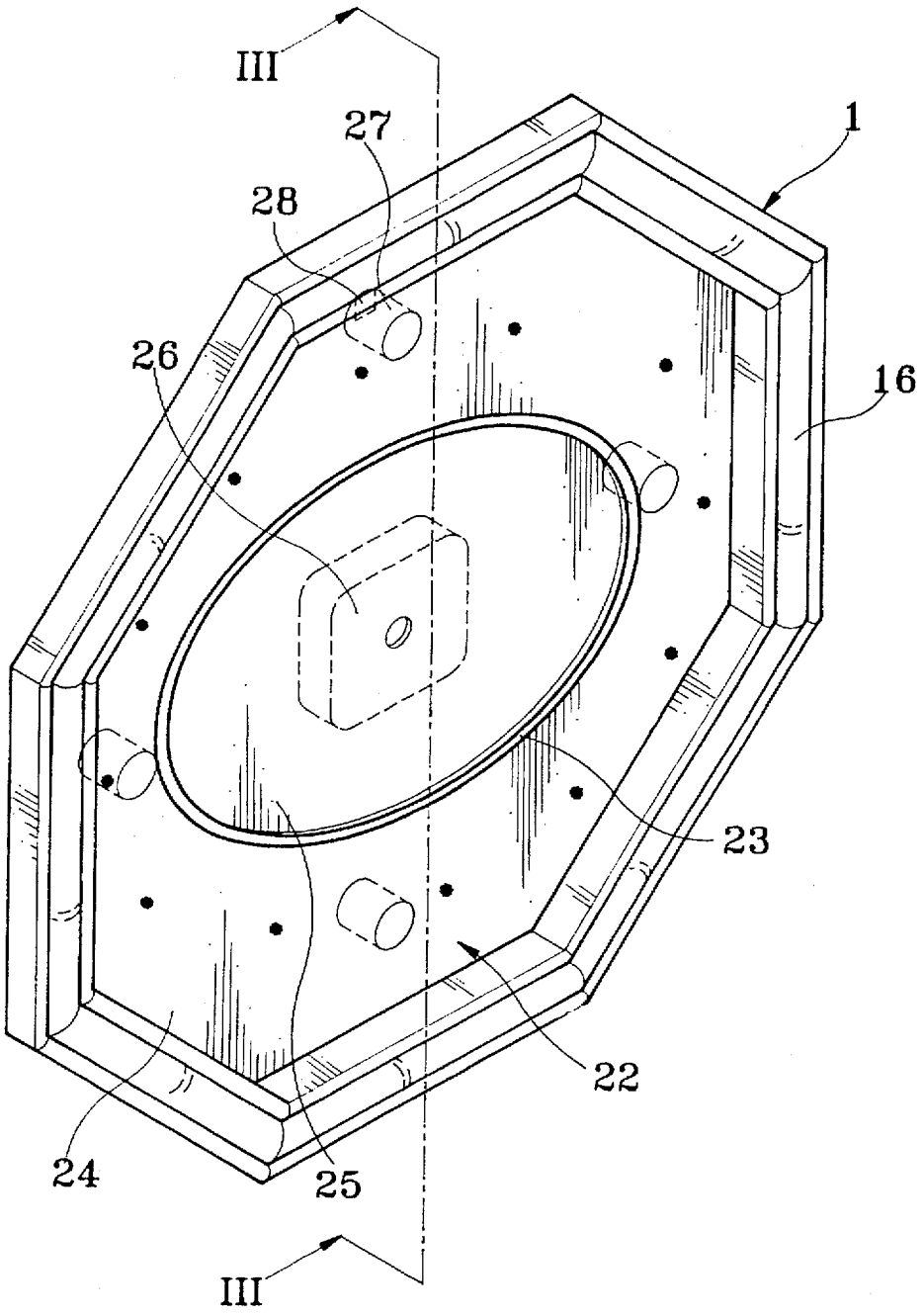
FIG. 1 is a perspective view of a clock shell according to one embodiment of the present invention.
Figure 2B:
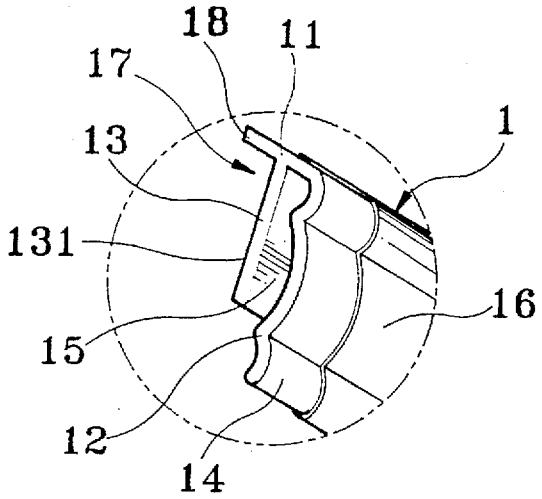
FIG. 2A is an exploded view of the clock shell shown in FIG. 1.
Figure 2A:
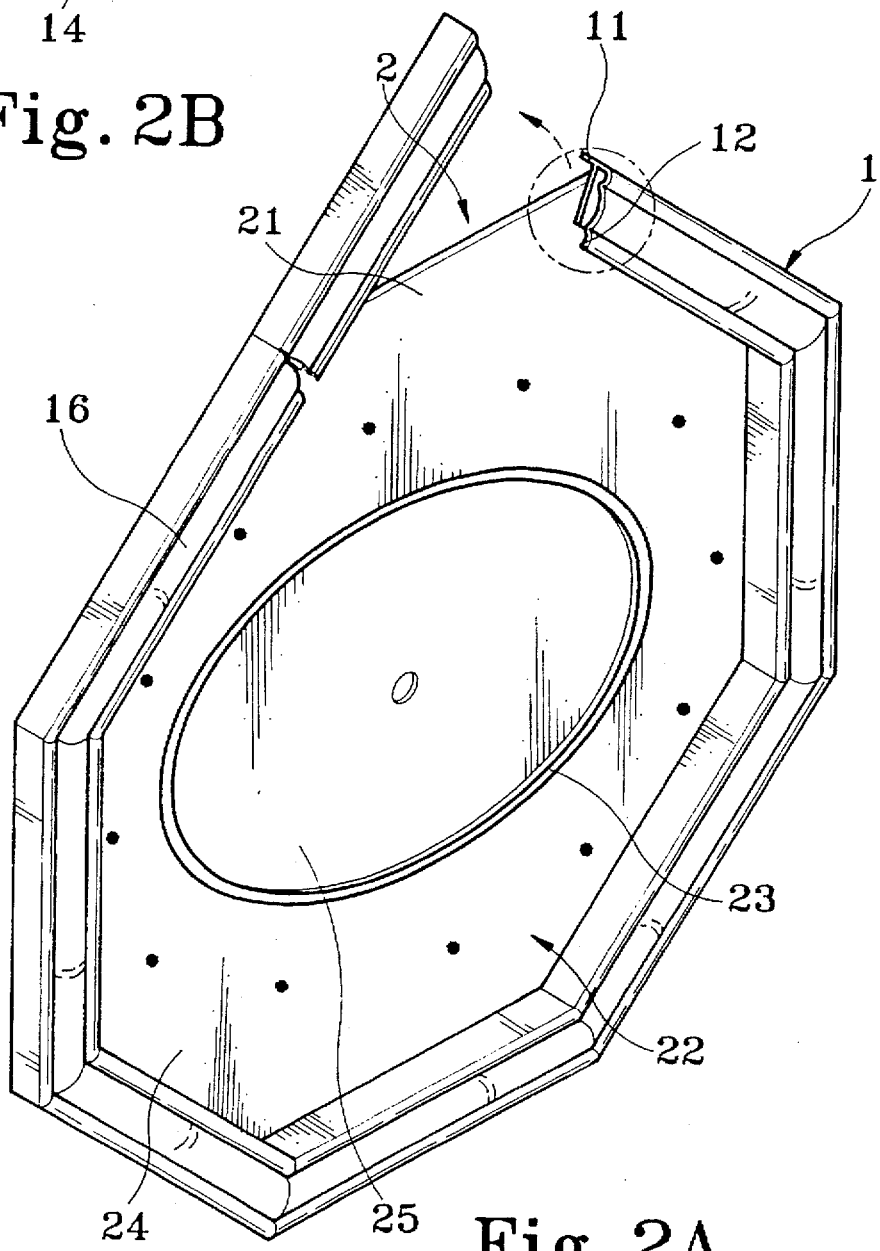

Referring to FIGS. 1, 2A, and 2B, a clock shell in accordance with the present invention, is comprised of a frame 1 and a shell 2.

The frame 1 is comprised of a plurality of frame sections 11 connected in series and adapted for mounting on the periphery of the shell 2. Each frame section 11 has two bevel cut edges 12 at two opposite ends through which the two opposite ends of the frame sections 11 are respectively abutted against one another, to form a particular shape. Each frame section 11 comprises a back clamping wall 13, a front clamping wall 14 a channel 15 defined between the back clamping wall 13 and the front clamping wall 14 and adapted for holding a protective cover plate 3, a backward flange 18, a mounting area 17 defined between the backward flange 18 and the back side 131 of the back clamping wall 13 and adapted for fastening to the border area 21 of the shell 2 by screws, a decorative covering layer 16 covered on the outside. The clamping wall 14 has a smoothly curved outer surface for decoration. When the frame sections 11 are cut from the frame 1, the decorative covering layer 16 is kept intact, so that the frame sections 11 are still maintained connected.

The shell 2 comprises a border area 21 connected to the mounting areas 17 of the frame sections 11, a front recess 22 defined at the front side within the border area 21, a raised endless line 23 raised from the front side of the front recess 22 and defining with the front side of the front recess 22 an outer decoration area 24 and an inner decoration area 25, a back chamber 26 at the back side adapted for holding a movement of a clock, and a plurality of stub rods 27 perpendicularly raised from the back side and defining a respective hanging hole 28 for hanging.

The frame 1 and the shell 2 are connected together by: fastening the the mounting areas 17 of the frame sections 11 of the frame 1 to the border area 21 of the shell 2 by screws, and abutting the two opposite ends of the frame 1 against each other.

Figure 3:
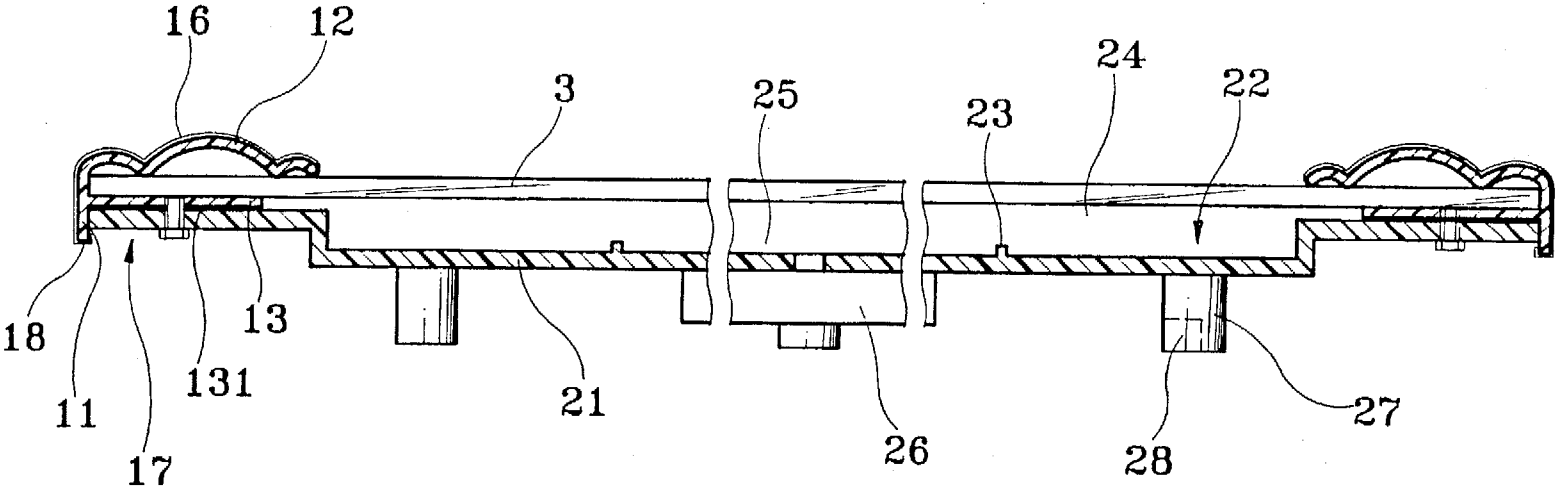
FIG. 3 is a sectional view taken along line III—III of FIG. 1.

Referring to FIG. 3, a protective cover plate 3 which can of any of a variety of materials is mounted in the channels 15 between the back clamping walls 13 and the front clamping walls 14 of the frame sections 11, and the mounting areas 17 of the frame sections 11 are fastened to the border area 21 of the shell 2 by screws. The decorative covering layer 16 can be a sticker or veneer, having a particular color or design,and glued to the surface of frame 1. The frame sections 11 have a smoothly curved or plain outer surface which decorates the appearance of the clock.

Figure 4:
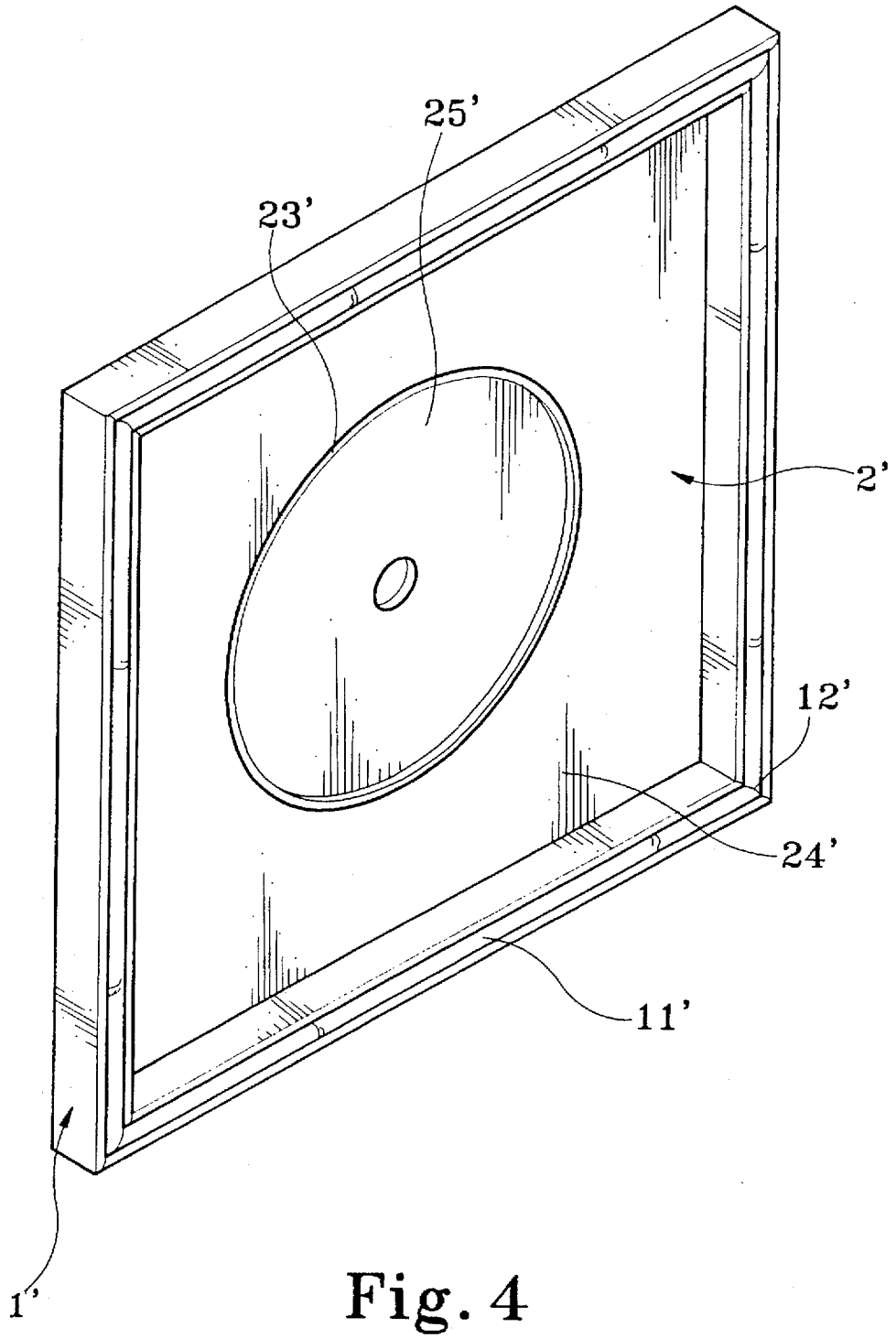
FIG. 4 shows an alternate form of the present invention.

FIG. 4 shows an alternate form of the present invention, in which the front side of the shell 2' is divided by a raised endless line 23' into an outer decoration area 24' and an inner decoration area 25'. The decoration area 24' 25' can be designed in the form of a dial of a clock, a pattern, a landscape, et. The raised endless line 23' can have an oval, circular, or polygonal configuration.

Figure 5:
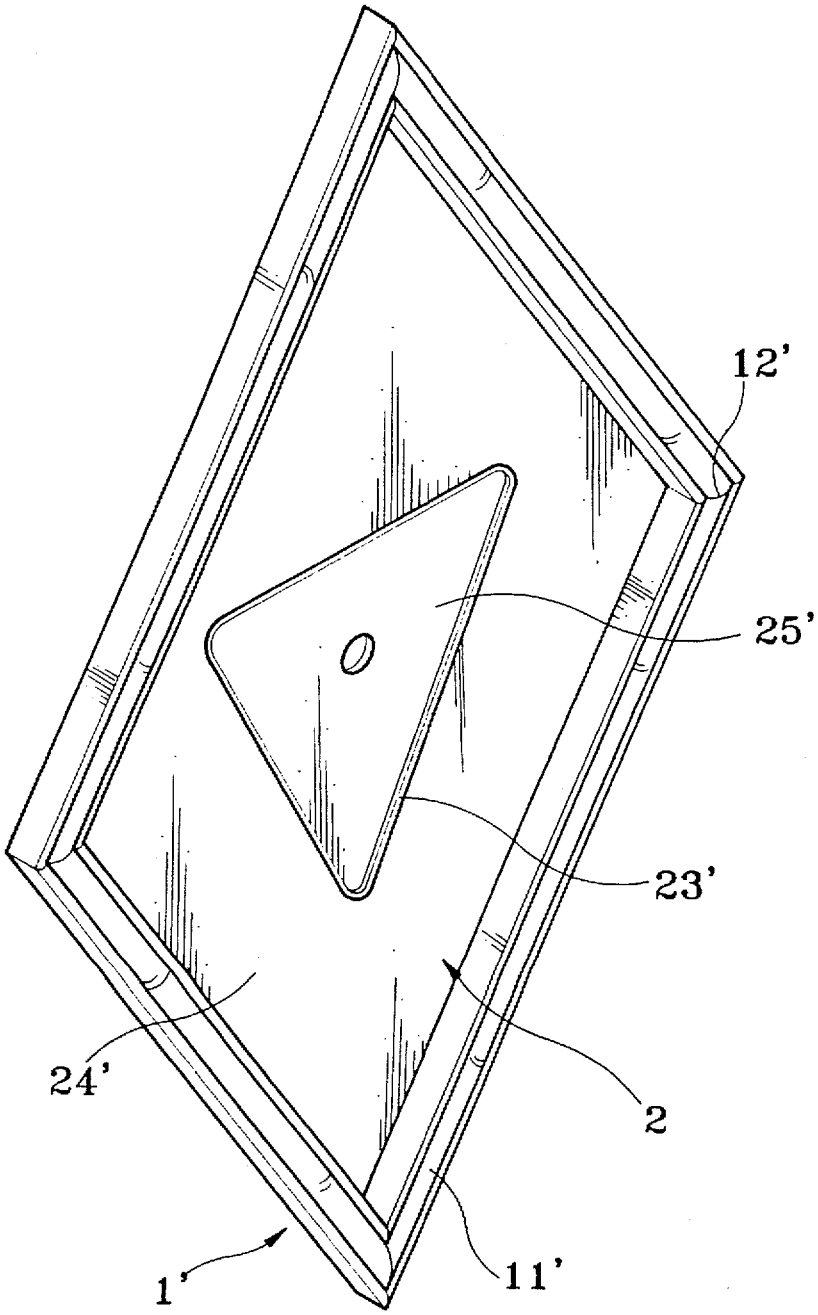
FIG. 5 shows another alternate form of the present invention.

FIG. 5 shows still another alternate. form of the present invention, in which the cut edges 12' of frame section 11' are abutted against one another, and the frame sections 11' are connected into a rectangular frame 1'.

I claim:

1. A clock shell comprising:

a frame, said frame comprising a plurality of frame sections connected in series, each of said frame sections having two bevel cut edges at two opposite ends through which said frame sections are respectively abutted against one another end by end to form a particular shape, each of said frame sections comprising a back clamping wall, a front clamping wall, a channel defined between said back clamping wall and said front clamping wall and adapted for holding a protective cover plate, a backward flange, a mounting area defined between said backward flange and a back side of said back clamping wall and adapted for fastening to a border area of a shell by screws, and a decorative covering layer covered on the outside; and a shell mounted within said frame, said shell comprising a border area fastened to the mounting areas of said frame sections, a front recess defined at a front side thereof within said border area, a raised endless line raised from the front side of said front recess and defining with said front recess an outer decoration area and an in decoration area.

2. The clock shell of claim 1 wherein said frame sections are cut from said frame and adhered to said decorative covering layer.

3. The clock shell of claim 1 wherein the front clamping wall of each of said frame sections has a smoothly curved outer surface.

4. The clock shell of claim 1 wherein the front clamping wall of each of said frame sections has a plain outer surface.

5. The clock shell of claim 1 wherein said decorative covering layer has a decorative pattern.

6. The clock shell of claim 1 wherein said raised endless line has an oval configuration.

7. The clock shell of claim 1 where in said raised endless line has a polygonal configuration.

8. The clock shell of claim 1 wherein said shell has a back chamber adapted for holding a movement of a clock.

9. The clock shell of claim 1 wherein said shell comprises a plurality of stub rods perpendicularly raised from a back side thereof and defining a respective hanging hole for hanging.

* * * * *